United States Patent [19]

Neelameggham et al.

[11] Patent Number: 4,533,442

[45] Date of Patent: Aug. 6, 1985

[54] LITHIUM METAL/ALLOY RECOVERY FROM MULTI-COMPONENT MOLTEN SALT

[75] Inventors: Ramaswami Neelameggham, Salt Lake City, Utah; John C. Priscu, Las Vegas, Nev.

[73] Assignee: AMAX Inc., Greenwich, Conn.

[21] Appl. No.: 636,439

[22] Filed: Jul. 31, 1984

[51] Int. Cl.[3] ..... C25C 3/02; C25C 3/04; C25C 3/36

[52] U.S. Cl. ..... 204/68; 204/69; 204/70; 204/71

[58] Field of Search ..... 204/68, 70, 69, 71

[56] References Cited

U.S. PATENT DOCUMENTS 3,418,223 12/1968 Love ..... 204/70

FOREIGN PATENT DOCUMENTS 1219900 1/1971 United Kingdom ..... 204/70

OTHER PUBLICATIONS

A.P.C. Application of Grothe, Ser. No. 340,402, Published May 18, 1943.

*Primary Examiner*—Howard S. Williams

*Attorney, Agent, or Firm*—Michael A. Ciomek; Eugene J. Kalil

[57] ABSTRACT

An electrolytic process is provided for the recovery of lithium values from a molten salt bath containing $MgCl_2$, $CaCl_2$, NaCl, KCl and LiCl. The salt composition in the molten state is subjected to the sequential depletion by electrolysis of the elements Mg, Ca, Na, respectively, either in substantially the elemental form or as an alloy thereof under multistage operating conditions to provide a depleted salt composition comprised substantially of the binary LiCl-KCl from which lithium is subsequently recovered by electrolysis as lithium per se or an alloy of Al/Li.

5 Claims, 2 Drawing Figures

LITHIUM METAL/ALLOY RECOVERY FROM MULTI-COMPONENT MOLTEN SALT

This invention relates to the recovery of lithium from multi-component halide salt compositions and, more particularly, to the electrolytic recovery of lithium from molten baths of halide compositions referred to as excess cell melt.

FIELD OF THE INVENTION

In the electrolysis of molten magnesium chloride, a multi-component salt composition (excess cell melt) is obtained comprising $MgCl_2$, $CaCl_2$, NaCl, KCl and LiCl. The amount of lithium chloride present is sufficiently substantial to encourage the economic recovery thereof. However, the presence of other metal chlorides can adversely affect the purity of electrolytic lithium.

Lithium is particularly attractive as an alloying metal in the production of Al/Li specialty aircraft alloy containing 3% Li. It would thus be desirable to provide an electrolytic process for the selective recovery of lithium, either as the metal per se, or as a master Al/Li alloy for use in the production of specialty aircraft alloys.

OBJECTS OF THE INVENTION

It is an object of the invention to provide an electrolytic process for the recovery of lithium from excess cell melt comprised of $MgCl_2$, $CaCl_2$, NaCl, KCl and LiCl.

Another object is to provide an electrolytic process for producing lithium metal and/or Al/Li alloy for use in specialty aircraft alloys, among other uses, e.g., as lithium electrodes in batteries.

These and other objects will more clearly appear when taken in conjunction with the following disclosure, the appended claims and the accompanying drawings.

THE DESCRIPTION OF THE DRAWINGS

BRIEF DESCRIPTION OF THE INVENTION

Stating it broadly, the lithium may be recovered by electrolysis by utilizing multi-component halide salt (e.g., excess cell melt) as cell feed to a multistage cell or cells to electrolyze sequentially Mg, Na, Ca and Li metal or Al/Li alloy.

In one embodiment, the multistage operation can be carried out in one cell with programmed depletion of each component, with varying temperature of the molten salt and replacement of cathodes to fit the programmed metal product being produced in sequence.

In another embodiment, the multistage electrolysis can be carried out in 4 or 5 cells operating in sequence with periodic molten salt interstage transfer. The last stage can be designed to recover lithium values either as metallic lithium or as an alumino-lithium master alloy using molten aluminum as the cathode. A cell with a series of compartments having bipolar electrodes may also be used.

In its broad aspects, the invention is directed to an electrolytic process for the recovery of lithium values from a multi-component molten salt composition containing $MgCl_2$, $CaCl_2$, NaCl, KCl and LiCl, the process comprising establishing an electrolyte bath of said composition in a cell having an anode and a cathode and passing an electric current through the electrolyte at a current density and voltage selective to the production of magnesium as known to those skilled in the art. Following removal of the magnesium from the cell, the salt composition remaining in the cell is electrolyzed at a current density and voltage selective to produce a product containing sodium/calcium at the cathode thereof.

The sodium/calcium product is separated from the salt composition remaining in the cell containing $CaCl_2$, KCl and LiCl and the salt composition is electrolyzed at a current density and voltage selective to the further removal of calcium and thereby leave a salt composition of LiCl and KCl which is thereafter subjected to electrolysis for the recovery of lithium.

The LiCl-KCl salt composition obtained during multistage electrolysis should preferably contain about 40% to 50% by weight of lithium chloride. The cathode may be made of steel or graphite or comprise a graphite bottom supporting molten aluminum which is cathodic and which takes up the lithium deposited thereon to form a master alloy of Al/Li. The master alloy may contain about 20% to 70% by weight of lithium, preferably 50% to 60% by weight of lithium, and the balance essentially aluminum.

DETAILS OF THE INVENTION

Figure 1:
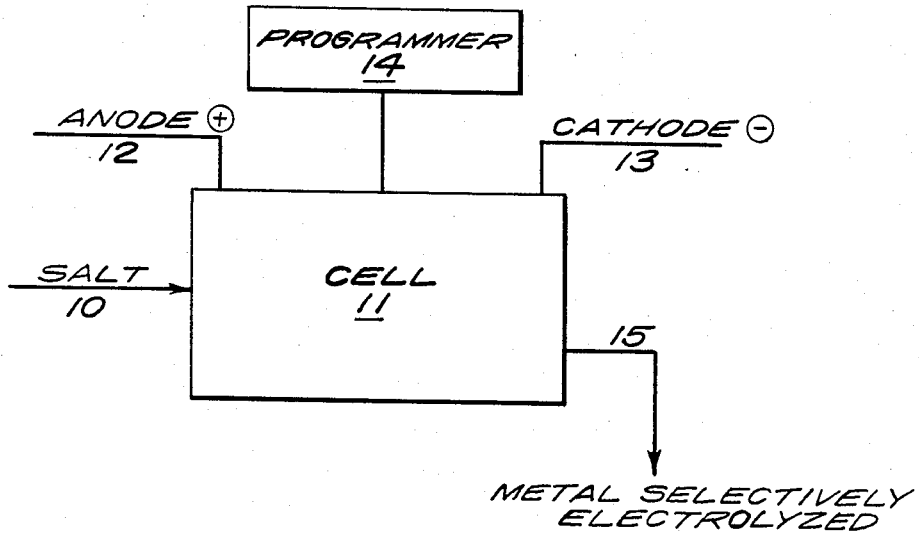
FIG. 1 is a schematic of a programmed electrolysis cell for the sequential recovery of metal from the group consisting of Mg, Ca, Na and Li.

FIG. 1 illustrates the use of a single cell programmed to effect multistage and sequential depletion of each of the elements Mg, Na, Ca and Li. Salt 10 is fed to cell 11 having anode 12 and cathode 13, the cell operation being controlled by programmer 14 to provide electrolyzed metal 15. As illustrative of this embodiment, the following example is given.

EXAMPLE

According to the example, about 4734 lb. of salt (10) of the following composition is fed to Stage 1 program of the cell: $MgCl_2$ 16%, LiCl 13.3%, $CaCl_2$ 21%, NaCl 35%, KCl 13.7% and $CaF_2$ 1%. The cell which has a dome is operated at 1080° to 1150° F. at 4 to 5 amperes/sq. inch with a starting voltage of about 9 V which decreases to about 7 V as crystalline magnesium metal is deposited on cathode 13 (Stage 1) for program Stage 1. The temperature is maintained as noted above by adjusting the cooling on cathode necks. At the end of the program of Stage 1, following an input of about 252 Kamphour charge, the microprocessor signals that it is time to remove cathode 13 and go to the program of Stage 2, using cathode 13 (Stage 2). At this point, the depleted electrolyte has a composition $MgCl_2$ 1%, LiCl 16%, $CaCl_2$ 25.3%, NaCl 40%, KCl 16.5% and $CaF_2$ 1.2%. In this stage the cell temperature is maintained at 1070° to 1100° F. at 4 to 5 amperes/sq. inch with a starting voltage of about 6 V for the particular cathode design. As sodium metal builds up in the dome of the cell, the sodium metal is allowed to overflow in a collector from the dome riser where the temperature of molten sodium is brought down to about 400° F. as in conventional sodium cells from where the metal product is removed by suction. The depth of the metal pool is measured by monitoring the differential level between the metal inside dome and the salt outside dome, while continuously using the microprocessor. The programmer signals the need to go to Stage 3 once the desired metal level is reached inside the dome following an input of 392.4 Kamphour. The composition of the electrolyte at the beginning of Stage 3 is $MgCl_2$ 0%, LiCl 26.8%, $CaCl_2$ 40.1%, NaCl 3.5%, KCl 27.6%, $CaF_2$ 2%. The Stage 3 cathode is used to replace Stage 2 cathode for calcium crystal deposition at a starting voltage of 9 V at 5 amp/sq. inch and continues to a final voltage of 7 V. The temperature of the electrolyte is maintained below 1050° and 1200° F. Following an input of about 240 Kamphour, the programmer signals that the cathode be replaced with that required for the final Stage 4 design. The composition at this point is $MgCl_2$ 0%, LiCl 47.3%, $CaCl_2$ 3.7%, NaCl 0%, KCl 48.8% and $CaF_2$ 0.2%. Stage 4 cathode can be a steel rod with a dome collector as used for sodium if pure lithium metal is required as the product. This cell is maintained at 840° F. and a voltage of 9 V at 14 amps/sq. inch. The completion of the batch is signalled by the programmer following an input of 195 Kamphour. If lithium-aluminum master alloy is the desired product, molten 30% lithium-aluminum alloy is fed to the cell floor and energized as a cathode through the central graphite floor slab. The initial voltage and temperature of the cell is about 10 V at 1020° F. which is slowly reduced to around 7 V and 980°–1020° F. when the cathodic pool becomes enriched in Li to about a content of 50–60% by weight following an input of about 195 Kamphour charge.

Figure 2:
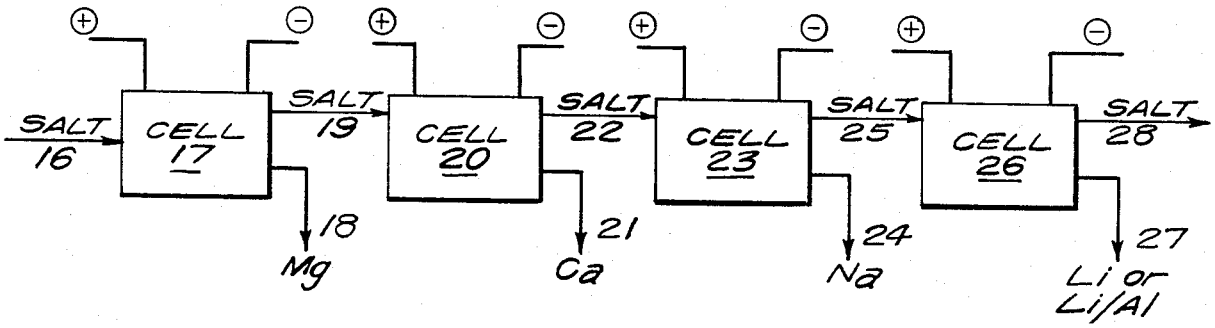
FIG. 2 depicts schematically a multistage arrangement of cells for the sequential recovery of the metals Mg, Ca, Na and Li.

FIG. 2 is a schematic showing the multistage extraction of lithium using 4 cells operating in sequence with periodic molten salt interstage transfer from one stage to the other instead of operating a single cell under programmed batch conditions as in the example. Salt 16 is fed to cell 17, the salt comprising 16% $MgCl_2$, 13.3% LiCl, 21% $CaCl_2$, 35% NaCl, 13.7% KCl and 1% $CaF_2$.

Following depletion of magnesium from the salt, magnesium 18 is removed from the cell as shown. The depleted salt 19 is fed to cell 20 and the conditions of electrolysis controlled to deplete the salt of calcium and the calcium 21 removed. The calcium-depleted salt 22 is next fed to cell 23 to further deplete it of sodium and the sodium 24 or the alloy thereof with calcium then removed from the cell.

The further depleted salt 25 is fed to cell 26, the salt preferably being a binary composition of LiCl-KCl. The lithium is recovered either as lithium per se or a master alloy of Li/Al 27 and provide a lithium depleted salt 28.

Similar parameters as noted for the example apply to the conditions needed for the sequential cells.

A multistage, sealed bipolar cell of the type disclosed in copending application Ser. No. 611,791, filed May 18, 1984 may also be employed with varying cathode configurations in carrying out the invention.

Passage of current through the bipolar cell will cause deposition of magnesium in the first few bipolar compartments, with the depleted salt entering succeeding compartments with its own main anode, main cathode and bipolar electrodes for each metal depletion in which the conditions are controlled to selectively control the deposition of calcium and sodium and deplete the salt composition of these metals so that the salt reaching the product end of the cell comprises substantially a binary of LiCl-KCl conducive to the deposition of lithium in product compartment.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. An electrolytic process for the recovery of lithium values from a multi-component molten salt composition containing $MgCl_2$, $CaCl_2$, NaCl, KCl and LiCl which comprises, establishing an electrolyte bath of said composition in a cell having an anode and a cathode, passing an electric current through said electrolyte in said cell at a current density and voltage selective to the production of magnesium, separating the magnesium in said cell from the salt composition remaining in said cell, electrolyzing the remaining salt composition at a current density and voltage selective to produce a product of sodium/calcium at the cathode thereof, separating said sodium/calcium product from the remaining salt composition in said cell containing $CaCl_2$, KCl and LiCl, electrolyzing said remaining salt composition at a current density and voltage selective to the further removal of calcium and thereby leave a salt composition of KCl-LiCl which is thereafter subjected to the further treatment thereof by electrolysis to recover lithium.

2. The electrolytic process of claim 1, wherein the lithium is recovered electrolytically by using a cathode comprising molten aluminum, whereby the lithium is electrodeposited as an alloy of Al/Li.

3. The electrolytic process of claim 1, wherein the multistage operation is carried out in a single cell which is programmed to effect the sequential depletion of the elements Mg, Ca and Na from said salt composition and provide said binary composition of LiCl-KCl from which lithium is then electrolytically recovered in accordance with the operation as programmed.

4. The electroytic process of claim 1, wherein the multistage operation is carried out by using a connecting series of cells sequentially arranged according to the element to be sequentially removed from the salt composition.

5. The electrolytic process of claim 1, wherein the multistage operation is carried out in a compartmentalized cell, wherein each of a particular compartment is used for sequentially depleting one of the elements Mg, Ca and Na such as to provide a depleted salt composition comprised of the binary LiCl-KCl which is finally electrolyzed to recover lithium therefrom.

* * * * *